US005609419A

United States Patent [19]

Byers, Jr.

[11] Patent Number: 5,609,419

[45] Date of Patent: Mar. 11, 1997

[54] CHALK BAG FOR ROCK CLIMBING

[76] Inventor: James H. Byers, Jr., 23010 Lake Forest Dr., #271, Laguna Hills, Calif. 92653

[21] Appl. No.: 427,421

[22] Filed: Apr. 24, 1995

[51] Int. Cl.[6] ..... B65D 33/30

[52] U.S. Cl. ..... 383/33; 383/22; 383/34; 383/35; 383/907; 224/674

[58] Field of Search ..... 383/22, 24, 33, 383/34, 35, 43, 907; 224/666, 674, 235, 654

[56] References Cited

U.S. PATENT DOCUMENTS

| | | | |
|---|---|---|---|
| 2,040,271 | 5/1936 | Rosenzweig . | |
| 2,150,627 | 3/1939 | Lieber . | |
| 3,782,601 | 1/1974 | Krawagna . | |
| 5,259,541 | 11/1993 | Reese | 224/674 X |

FOREIGN PATENT DOCUMENTS

| | | | |
|---|---|---|---|
| 373151 | 4/1923 | Germany | 383/43 |
| 26598 | 8/1898 | United Kingdom . | |

*Primary Examiner*—Jes F. Pascua

*Attorney, Agent, or Firm*—Poms, Smith, Lande & Rose

[57] ABSTRACT

A chalk bag for climbers includes a flexible bag structure with an internal cavity for holding chalk and an upper opening providing a passage to the cavity when open. A closure device circumscribes the opening and when open configures the opening in substantially circular shape for receiving the hand of a climber for chalking. When closed, the closure device configures opposite walls of the bag structure in engagement with one another in a substantially half-circular arcuate configuration. The chalk bag is wedge shaped in side elevation view to dispose the shape-retaining opening in vertically open disposition when the climber is standing with the chalk bag secured at the waist in the small of the back. Consequently, the climber can access the chalk within the bag easily with either hand, and may open and close the bag with either hand and with only one hand.

12 Claims, 2 Drawing Sheets

FIG. 4.
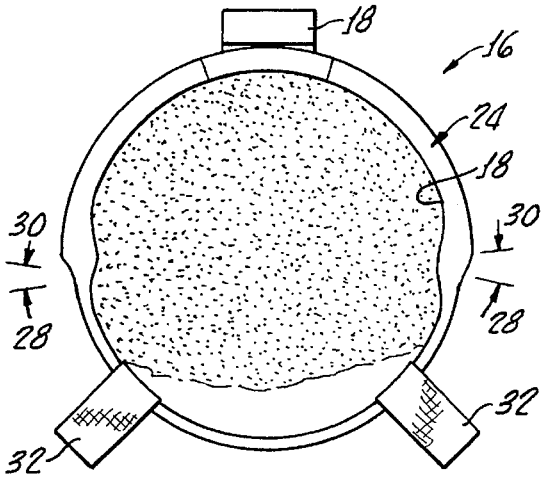
FIG. 5.
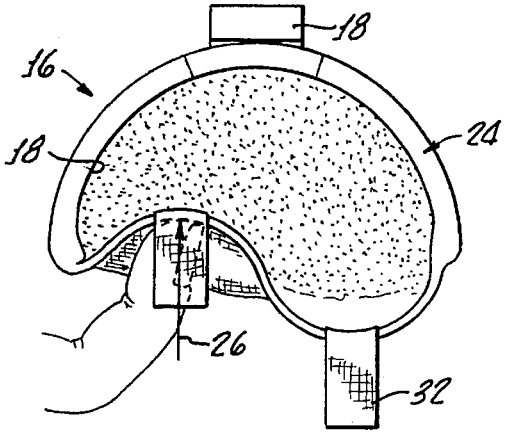
FIG. 7.
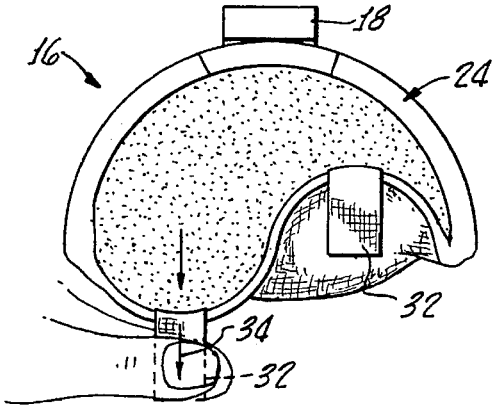
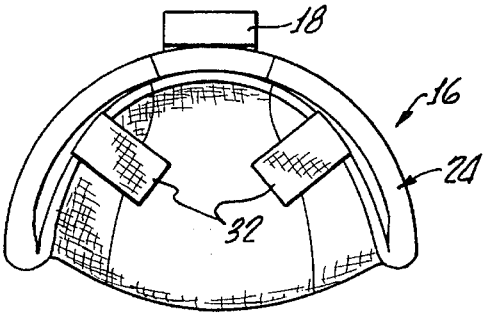
FIG. 6.
FIG. 9.
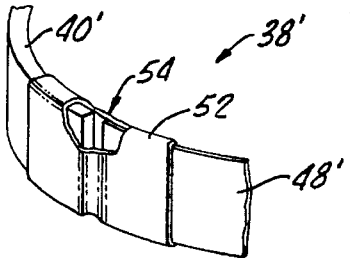
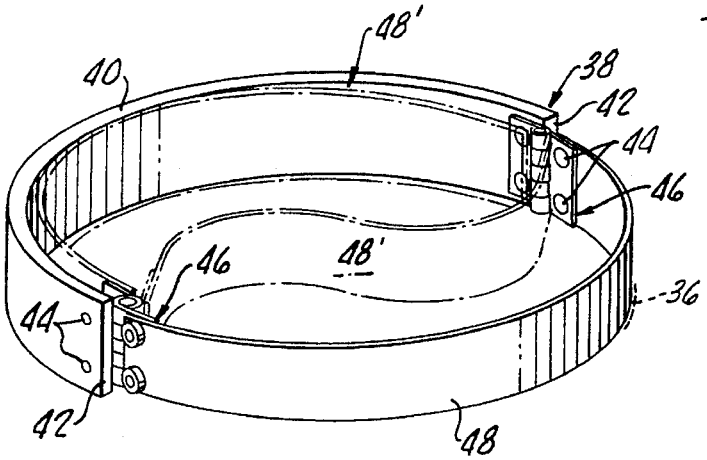
FIG. 8.
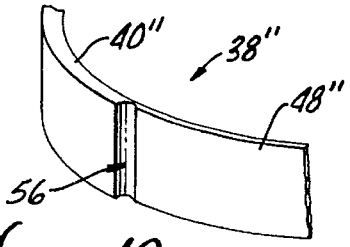
FIG. 10.

CHALK BAG FOR ROCK CLIMBING

BACKGROUND OF THE INVENTION

1. Field of the Invention

The present invention is in the field of chalk bags worn by climbers, and which are used by climbers to carry and dispense chalk onto the climber's hands to improve their grip on climbing surfaces. These chalk bags are used by climbers, such as rock climbers, to carry and dispense chalk onto the climbers hands and fingers both prior to and during climbing.

2. Related Technology

Conventional climber's chalk bags are required to retain chunk or powdered chalk, for example, within the bag while also allowing the climber to quickly and easily access the chalk with either hand during a climb. On the other hand, the conventional chalk bags are so designed that it can be difficult for a climber to access the chalk with the hand. That is, the opening of some conventional chalk bags is a type with a draw-string mouth, and is partially obstructed even when the bag is open. This type of chalk bag closure makes access to the chalk with a climber's hand undesirably difficult. Also, this type of closure can not generally be operated with only a single hand to either open or close the chalk bag.

A conventional closure or fastening device for a pouch (such as a tobacco pouch) is known in accord with British patent No. 26,598, dating from an application filed on 15 Nov. 1897. According to the disclosure of this patent, a tobacco pouch may include a closure having an elongate shape-retaining curved piece of sheet metal which is hinged at its ends to and carries respective ends of a matching elongate flexible and resilient piece of metal. The pouch is secured at its mouth to the closure by folding the flexible cloth or leather material, for example, of the pouch over the closure to form a sewn hem. The flexible piece of metal may be manually sprung between a position in which it lays adjacent to the curved piece, closing the pouch; and another position sprung away from the curved piece of metal. In the second position of the flexible piece of metal as described, the pouch will have a somewhat ellipsoidal-shaped opening.

Similar closures are disclosed in U.S. Pat. No. 2,040,271, issued 12 May 1936 to D. Rosenzweig; and U.S. Pat. No. 2,150,627, issued 14 Mar. 1939 to I. Lieber. Each of these closures include an elongate curved substantially rigid member hingeably connected near its ends to respective ends of an elongate flexible and resilient member. The flexible member may be manually snapped between an open and a closed position. In the closed position of the flexible member, the pouch, handbag or container, for example, which is fitted with the closure device will be closed and will have a curved configuration. In the open position of the closure, the mouth of the pouch or handbag will be open to a generally elliptical shape.

All of these conventional closures when open provide an opening which is an ellipsoid, or is shaped like a pair cycloidal segments or circular segments arranged on opposite sides of an axis of symmetry. These opening shapes provide a pair of opposite cusps or corners from which contents may be poured. However, for a climber's chalk bag, the contents of the bag are not intended to be poured out. In fact, an opening shape with a defined cusp or corner is undesirable because climbers may maneuver their bodies while climbing into positions in which the chalk is poured out of such a chalk bag and is lost. Also, the existence of such cusps is undesirable for a climber's chalk bag because the access to the contents of the bag is made more difficult by the opening shape which does not best accommodate the human hand.

An additional conventional bi-stable closure device for flexible bags is known in accord with U.S. Pat. No. 3,782,601, issued 1 Jan. 1974 to A. A. Krawagna. According to the disclosure of this patent, a snap-closure includes a plate portion and a collar portion integral along one edge with the plate portion via a flexible web. The plate and collar seek one of two stable positions. In one of these stable positions, a corner opening of a bag to which the closure is secured is open so that contents of the bag can be dispensed though the opening. In the other of the two stable positions, the walls of the bag are strung tightly across the plate portion of the closure to close the bag opening.

However, none of these conventional closure devices provides a substantially circular and unobstructed opening when open and also closes tightly when closed. Desirably, a climber's chalk bag should provide a circular opening just sufficiently large enough to accept a climber's hand for chalking, but also sufficiently small as to retain the chalk contained in the bag. That is, the opening should not be larger than required for inserting the climber's hand, and should not have a shape which facilitates spilling or loss of the chalk from the open bag. Further, such a climber's chalk bag should be easily opened and closed with a single hand, and with either hand. Additionally, such a climber's chalk bag should provide a shape-retaining opening which when open allows a climber to easily and certainly insert the fingers or an entire hand for chalking, and without an overly tight opening which could trap or catch the climber's hand at a critical moment.

SUMMARY OF THE INVENTION

In view of the deficiencies of convention climber's chalk bags, a primary object for this invention is to overcome one or more of these deficiencies.

An additional object for this invention is to provide a climber's chalk bag with a substantially circular and unobstructed opening when open.

Yet another object for this invention is to provide such a climber's chalk bag which closes tightly when closed.

Still another object for the present invention is to provide such a climber's chalk bag which provides a circular opening just sufficiently large enough to accept a climber's hand for chalking, but also sufficiently small as to retain the chalk contained in the bag.

Another object for the chalk bag of the present invention is to be easily opened and closed with a single hand, and with either hand.

Additionally, such a climber's chalk bag according to an object of this invention provides a shape-retaining opening which when open allows a climber to easily and certainly insert the fingers or an entire hand for chalking.

Accordingly, the present invention provides according to an aspect thereof a chalk bag for climbing, the chalk bag including a flexible bag structure having an opening to an internal cavity, the bag structure being adapted to receive and contain chalk in the cavity, means for securing the flexible bag structure to a climber, a closure device associated with the opening of the flexible bag structure, the closure device including means for in an open first position disposing the flexible bag structure at the opening in a shape-retaining substantially circular configuration providing a substantially circular passage into the cavity of the bag structure, and in a closed second position disposing opposite walls at the opening of the flexible bag structure adjacent to one another to substantially close the passage into an arcuate substantially half-circular shape.

These and additional objects and advantages of the present invention will be apparent from a reading of the following detailed description of a single exemplary embodiment of the present invention, when taken in conjunction with the following drawing Figures, which are further described below.

BRIEF DESCRIPTION OF THE DRAWING FIGURES

FIG. 1 provides a perspective and somewhat diagrammatic view of a climber ascending a rock face, and wearing a chalk bag embodying the present invention;

FIG. 2 is an enlarged fragmentary perspective view of a portion of FIG. 1, showing the chalk bag in greater detail;

FIG. 3 provides a side elevation view of the chalk bag embodying the present invention;

FIG. 4 provides a plan view of the open chalk bag, looking into the substantially circular opening provided by the bag for accepting a hand for chalking;

FIG. 5 is a plan view similar to FIG. 4, but showing the bag in the process of being closed;

FIG. 6 is a plan view of the chalk bag in its closed position;

Figure 11:
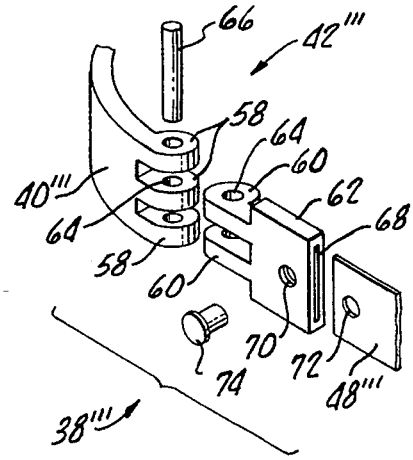

FIG. 7 provides a similar plan view of the chalk bag in the process of being opened, which may be accomplished with one hand, and with either hand;

FIG. 8 presents a fragmentary perspective view of the chalk bag with parts thereof shown in phantom or broken away for clarity of illustration;

FIG. 9 provides a fragmentary elevational view of an alternative embodiment of the present inventive chalk bag;

FIG. 10 presents a fragmentary perspective view of yet another alternative embodiment of the present invention; and FIG. 11 presents a fragmentary perspective view of still another alternative embodiment of the present invention.

DETAILED DESCRIPTION OF THE PREFERRED EXEMPLARY EMBODIMENTS OF THE INVENTION

Figure 1:
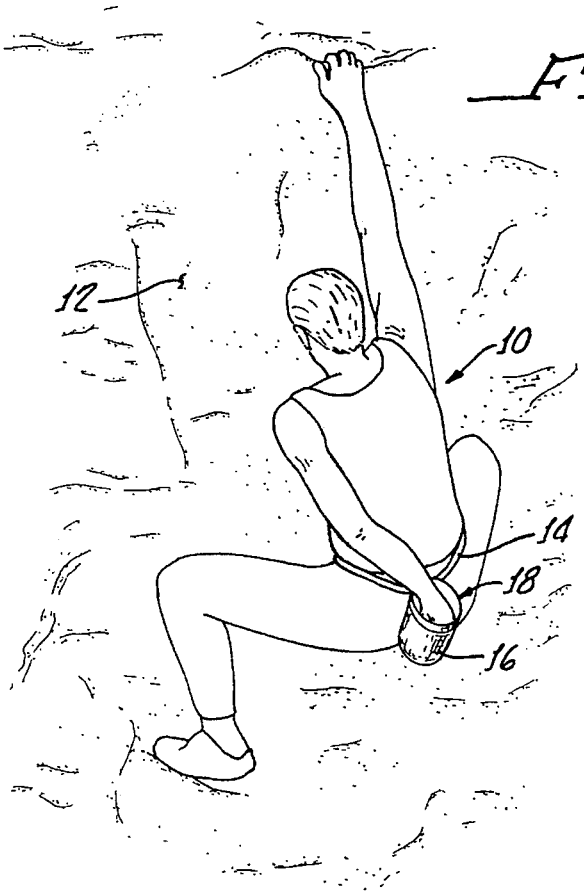

Viewing now FIGS. 1–8 in conjunction, and considering first FIG. 1, a climber 10 is seen ascending a rock face 12. The climber is ascending the rock face using the purchase and grasp on the rock surface which can be achieved using the hands and feet. Accordingly, in order to improve the grasp which may be obtained with the hands, the climber occasionally applies chalk to the fingers or entire hand in order to absorb perspiration and improve friction with the rock surface. In order to provide a convenient source of chalk which can be accessed both prior to and during a climb, the climber 10 wears a belt 14 upon which is secured a chalk bag 16 in the center of the climber's lower back. This chalk bag defines an internal cavity for receiving chalk (not shown) and an upper shape-retaining and substantially circular opening, which is generally referenced with the numeral 18. Because of the position of the chalk bag 16 in the center of the climber's lower back, the climber 10 can access chalk within the bag 16 using either hand by reaching behind the back through the opening 18 and into the bag.

Figure 2:
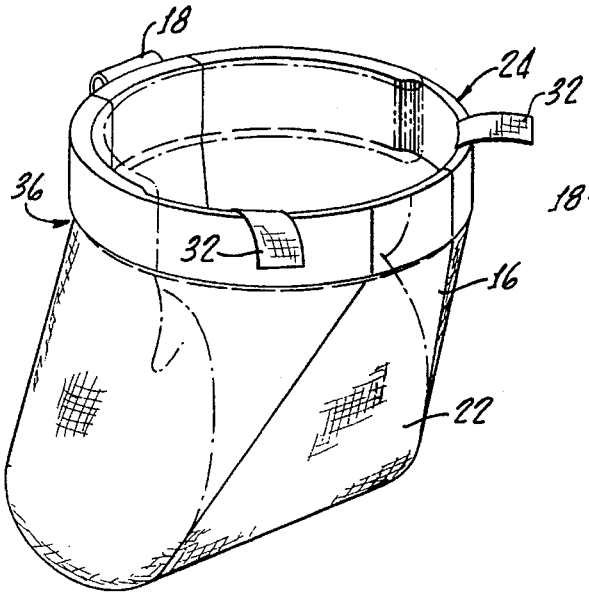
Figure 3:
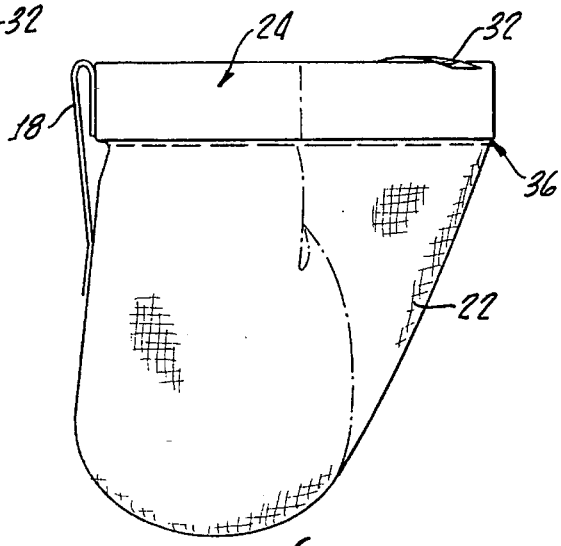

FIGS. 2 and 3 provide respective enlarged perspective and side elevation views of the climber's chalk bag 10. It is seen that the climber's chalk bag 16 includes a belt loop 20 secured upon a belt worn by the climber 10. This belt loop 20 supports a depending flexible bag structure 22, which includes a shape-retaining closure structure, generally indicated with the arrow 24 in FIG. 2. The bag structure 22 is substantially formed of flexible cloth or sheet material having a nature (i.e., weave and density of threads if made of cloth) which will retain chalk powder or chalk chunks within the bag 12. As is seen in FIG. 3, the bag structure 22 is somewhat wedge-shaped to be supported against the small of the climbers lower back with the opening 18 disposed for convenient access to either one of the climber's hands. That is, the climber 10 can easily reach either hand behind the back and into the opening 18 to access the chalk in the bag 16.

FIG. 4 provides a plan view of the chalk bag 10 looking into the opening 18 into the interior of the bag 16. Viewing FIG. 4, it is seen that the opening 18 is substantially circular and is of sufficient size to accept the fingers or the entire hand of a climber for chalking. The opening 18 is substantially circular in shape and provides a passage to the chalk cavity of the bag structure 22 which is just sufficiently large enough to accept one of the climber's hands. This opening and passage 18 is maintained substantially circular in shape by the shape-retaining closure structure 24. Consequently, the climber 10 can easily access the chalk with in the bag 16. Also, and in contrast to conventional closures which provide an ellipsoidal-shaped opening with a pair of opposite corners or cusps, the circular opening 18 of the bag 16 is without corners which could limit access to the chalk for the climber's hand.

As FIG. 5 shows, the opening 18 of bag 16 may be closed by manually applying an inward closing pressure (indicated with force arrow 26) to a flexible circular segment of the bag closure structure 24, which flexible circular segment is generally indicated with the segment arrows 28. The segment 28 is substantially half-circular. This manually applied pressure 26 causes the closure structure 24 to resiliently deform into and through a S-shape as is seen in FIG. 5. It will be understood that the closing pressure 26 may be applied with either hand and that the shape of the flexible segment of the closure structure 24 may be an S-shape of a Z-shape depending upon which hand is used to apply the closing pressure 26, and where this pressure is applied. The closing pressure 26 need not be applied at any precise part of the flexible segment 28. In fact application of closing force 26 at any one or a combination of many locations within the segment 28 will be sufficient to cause the closure 24 to resiliently move toward and to its closed position.

FIG. 6 shows that in the closed position of the closure structure 24, the chalk bag 16 at opening 18 has an arcuate shape. That is, the flexible segment 28 of the closure structure 24 is inverted to lay closely adjacent to a rigid segment, generally indicated with the segment arrows 30. The rigid segment 30 is also substantially half-circular. In order to provide a convenient way for the climber 10 to open the bag 16, a pair of pull tabs 32 are attached to the flexible segment 28 at about the 5 o-clock and 7 o-clock positions, with the center of the rigid segment 30 being at 12 o-clock. FIG. 7 shows that the climber 10 may open the bag 16 by pulling on either one of the pull tabs 32, as is indicated by manual force arrow 34. The flexible segment 28 will snap through its S-shape or Z-shape, dependent upon which hand and which one of the pull tabs 32 is used to apply the force 34 to the flexible segment 28.

FIG. 8 reveals that the closure structure 24 includes an upper hem 36 of the bag structure 22 within which is sewn a closure device 38. The closure device 38 and material of the bag structure 22 at hem 36 cooperatively define the closure structure 24, including the belt loop 20 and pull tabs 32. Closure device 38 includes a substantially half-circular rigid member 40 having opposite ends 42. This rigid member 40 may be made of high-strength, light-weight engineering plastic, for example, and defines the segment 30, recalling the description of FIGS. 4–7. Attached to the opposite ends 42 by fasteners 44 passing through respective holes (not shown) in the member 40 is a respective one of a pair of strap hinges 46. These hinges 46 carry respective opposite ends of a similarly half-circular (in a first open position of the closure structure 24 and closure device 28) flexible member 48. The member 48 may be made of spring steel strip, for example, and is attached to the hinges 46 by similar fasteners 50 passing though holes in the spring steel strip forming the member 48. FIG. 8 shows with dashed lines that the flexible member 48 may be sprung or snapped to a closed second position (indicated with dashed lead line and reference numeral 48') in which the member 48 lies closely adjacent to and nests within the rigid member 40. Consequently, the material of the bag 22 structure at hem 36 is pressed together so that chalk cannot escape from within the bag. In this closed second position of the flexible member 48, the opening of bag structure 22 has a generally arcuate shape.

FIG. 9 depicts an alternative embodiment of the present invention in which all features except the construction of the closure device 38 are the same. In order to obtain reference numerals for use in describing the alternative embodiment of FIG. 9, features which are either the same or analogous in structure or function to those features depicted and described above are referenced with the same numeral used above and having a prime (') added thereto. Viewing FIG. 9, it is seen that the closure device 38' includes a half-circular rigid member 40'. At the ends of the rigid member 40' (only one end being shown, with both ends the same), a length of flexible but high-strength heat-shrink tubing 52 is shrunk onto the member 40'. Similarly, this heat shrink tubing 52 is shrunk onto an adjacent end of the flexible member 48', leaving a space 54 between the members 40' and 48' The heat shrink tubing 52 spanning the space 54 necks down and effectively defines an integral flexible hinge feature connecting the members 40 and 48. An advantage of the embodiment shown in FIG. 9 is that holes for fasteners need not be formed or drilled in the spring steel strip of member 48. As can be appreciated, this spring steel strip is very hard after being tempered to spring-steel condition. Accordingly, the embodiment shown in FIG. 9 allows the members 40 and 48 to be hingeably connected inexpensively and conveniently with a hinge structure (heat shrink tubing 52) which is very durable.

FIG. 10 provides a fragmentary perspective view of yet another alternative embodiment of the present invention. In order to obtain reference numerals for use in describing the alternative embodiment of FIG. 10, features which are either the same or analogous in structure or function to those features depicted and described above with reference to FIGS. 1–9, are referenced with the same numeral used above and having a double prime (") added thereto. Again, all features except the construction of the closure device 38" are the same as in the first embodiment of the invention depicted and described above. Viewing FIG. 10, it is seen that the closure device 38" is integral and of one piece. That is, the closure device 38" includes a comparatively thick portion 40" (analogous to member 40) and a comparatively thin portion 48" (analogous to member 48). The portions 40" and 48" are connected to one another by an integral hinge portion 56. The closure device 38" may be fabricated from a high-strength, resilient, light-weight, and durable engineering plastic, which has good tolerance to the repeated flexing which takes place in the integral hinge portion 56. Because of its thickness, the portion 40" is comparatively rigid, while the portion 48" is comparatively flexible because of its thinness. The resilient nature of the plastic material from which the closure device 38" is formed provides sufficient "springiness" for the portion 48" to allow the chalk bag 16" to be opened and closed as described above.

FIG. 11 provides a fragmentary perspective view of still another alternative embodiment of the present invention. In order to obtain reference numerals for use in describing the alternative embodiment of FIG. 11, features which are either the same or analogous in structure or function to those features depicted and described above with reference to FIGS. 1–10, are referenced with the same numeral used above and having a triple prime (''') added thereto. Again, all features except the construction of the closure device 38''' are the same as in the first embodiment of the invention depicted and described above. Viewing FIG. 11, it is seen that the rigid member 40''' includes end portions 42''' (only one of which is illustrated, with both end portions 42''' of the member 40''' being the same), which include integrally formed and spaced apart hinge knuckle features 58. The hinge knuckles 58 are offset slightly toward the inside of this member (i.e., toward the center of the semi-circular arcuate shape of the member 40''') in order to allow the closure device 38''' to achieve the closed position, seen in FIG. 2. Interdigitating with the knuckles 58 are integral knuckles 60 of a socket member 62. The knuckles 60 are also offset slightly inwardly of the socket member 62 in order to allow the closure device 38 to achieve the closed position illustrated in FIG. 2 as was explained above. Knuckles 58 and 60 define corresponding ones of plural aligned hinge pin holes 64. A hinge pin 66 is received in the holes 64 to hingeably connect the member 40''' to socket member 62. In order to secure the flexible spring member 48''' to the socket member 62, the latter defines an elongate socket 68 (only the end opening of which is visible in FIG. 11),which is shaped to closely match the cross sectional shape of the spring steel strip from which the member 48''' is fabricated. The member 62 defines a pair of aligned rivet holes 70 crossing the socket 68, and the flexible spring member 48''' includes a hole 72 aligning with these holes 70 when the end of this spring member 48''' is fully inserted into the socket 68. A rivet 74 is passed through the holes 70 and 72, and is headed to retain the spring flex member 48''' permanently in engagement with the socket member 62.

While the present invention has been depicted, described, and is defined by reference to particularly preferred embodiments of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiments of the invention are exemplary only, and are not exhaustive of the scope of the invention. Consequently, the invention is intended to be limited only by the spirit and scope of the appended claims, giving full cognizance to equivalents in all respects.

I claim:

1. A bag for receiving an article which are to be easily accessed with the hand, said bag comprising:

a flexible bag structure having an opening to an internal cavity, said bag structure being adapted to receive and contain the article in said cavity;

means for securing said flexible bag structure to a person;

a closure device associated with said opening of said flexible bag structure, said closure device including means for in an open first position disposing said flexible bag structure at said opening in a shape-retaining substantially circular configuration providing a substantially circular passage into said cavity of said bag structure, and in a closed second position disposing opposite walls at said opening of said flexible bag structure adjacent to one another to substantially close said passage into an arcuate substantially half-circular shape;

wherein said closure device includes a substantially rigid and substantially half-circular member partially circumscribing said opening and having a pair of opposite end portions, an elongate resilient flexible member also having a pair of end portions and also being of substantially half-circular shape in said open first position and said closed second position of said closure device, said flexible member partially circumscribing said opening in opposition to said rigid member in said open first position of said closure device, and hinge means attaching respective end portions of said substantially rigid member and said flexible member to one another so as to allow said flexible member to flex between said first and said second positions, in said closed second position said flexible member laying adjacent to said rigid member to urge opposite walls of said bag structure into association with one another at said opening, closing said opening into a substantially half-circular arcuate shape;

wherein said hinge means of said closure device includes structure connecting adjacent end portions of said substantially rigid member and of said elongate resilient flexible member to one another and including an integral flexible hinge portion; and wherein said hinge means of said closure device includes a length of heat-shrink tubing connecting adjacent end portions of said substantially rigid member and of said elongate resilient flexible member to one another in spaced apart relation to provide therebetween a flexible integral hinge portion of said heat-shrink tubing.

2. The bag of claim 1 wherein said flexible bag structure is formed of flexible cloth or sheet material.

3. The bag of claim 1 wherein said means for securing said flexible bag structure to a person includes a belt loop secured to an upper portion of said flexible bag structure adjacent to said opening.

4. The bag of claim 1 wherein said flexible member includes a strip of spring steel.

5. The bag of claim 1 further including a pair of pull tabs secured adjacent to said opening at spaced apart locations within the half-circular extent of said elongate flexible member, thereby providing for easy manual opening of said bag by application of manual pulling force to either one of said pair of pull tabs.

6. A bag for receiving an article which are to be easily accessed with the hand, said bag comprising:

a flexible bag structure having an opening to an internal cavity, said bag structure being adapted to receive and contain the article in said cavity;

means for securing said flexible bag structure to a person;

a closure device associated with said opening of said flexible bag structure, said closure device including means for in an open first position disposing said flexible bag structure at said opening in a shape-retaining substantially circular configuration providing a substantially circular passage into said cavity of said bag structure, and in a closed second position disposing opposite walls at said opening of said flexible bag structure adjacent to one another to substantially close said passage into an arcuate substantially half-circular shape;

wherein said closure device includes a substantially rigid and substantially half-circular member partially circumscribing said opening and having a pair of opposite end portions, an elongate resilient flexible member also having a pair of end portions and also being of substantially half-circular shape in said open first position and said closed second position of said closure device, said flexible member partially circumscribing said opening in opposition to said rigid member in said open first position of said closure device, and hinge means attaching respective end portions of said substantially rigid member and said flexible member to one another so as to allow said flexible member to flex between said first and said second positions, in said closed second position said flexible member laying adjacent to said rigid member to urge opposite walls of said bag structure into association with one another at said opening, closing said opening into a substantially half-circular arcuate shape; said hinge means of said closure device includes said substantially rigid member and said flexible member being integral with one another and cooperatively defining a flexible connecting integral hinge portion connecting adjacent end portions of said substantially rigid member and of said elongate resilient flexible member to one another; and wherein said hinge means of said closure device includes a length of heat-shrink tubing connecting adjacent end portions of said substantially rigid member and of said elongate resilient flexible member to one another in spaced apart relation to provide therebetween a flexible integral hinge portion of said heat-shrink tubing.

7. The bag of claim 6 wherein said flexible member includes a strip of spring steel.

8. The bag of claim 6 further including a pair of pull tabs secured adjacent to said opening at spaced apart locations within the half-circular extent of said elongate flexible member, thereby providing for easy manual opening of said bag by application of manual pulling force to either one of said pair of pull tabs.

9. A chalk bag for climbing, said chalk bag comprising:

a flexible bag structure formed of cloth and having a hemmed upper opening to an internal cavity, said bag structure including opposite wall portions cooperatively defining said opening, said cloth of said bag structure being selected to contain chalk in said cavity;

a belt loop attached adjacent to said opening for securing said flexible bag structure to the belt of a climber;

a closure device disposed within said hem of said opening of said flexible bag structure, said closure device including means for in an open first position disposing said flexible bag structure at said opening in a shape-retaining substantially circular configuration providing a substantially circular passage into said cavity of said bag structure, and in a closed second position disposing opposite walls at said opening of said flexible bag structure adjacent to one another to substantially close said passage into an arcuate substantially half-circular shape;

wherein said closure device includes a substantially rigid and substantially half-circular member partially circumscribing said opening and having a pair of opposite end portions, an elongate resilient flexible member also having a pair of end portions and also being of substantially half-circular shape in said open first position and said closed second position of said closure device, said flexible member partially circumscribing said opening in opposition to said rigid member in said open first position of said closure device, and hinge means attaching respective adjacent end portions of said substantially rigid member and said flexible member to one another so as to allow said flexible member to flex between said first and said second positions, in said closed second position said flexible member laying adjacent to said rigid member to urge opposite walls of said bag structure into association with one another at said opening, thereby closing said opening into a substantially half-circular arcuate shape;

wherein said flexible bag structure is wedge shaped in side elevation view to dispose said upper opening generally open vertically when said climber is standing with said chalk bag secured at the waist in the small of the back; and wherein said hinge means of said closure device includes a length of heat-shrink tubing connecting adjacent end portions of said substantially rigid member and of said elongate resilient flexible member to one another in spaced apart relation to provide therebetween a flexible integral hinge portion of said heat-shrink tubing.

10. The chalk bag of claim 9 wherein said flexible member includes a strip of spring steel.

11. The chalk bag of claim 9 further including a pair of pull tabs secured adjacent to said opening at spaced apart locations within the half-circular extent of said elongate flexible member, thereby providing for easy manual opening of said chalk bag by application of manual pulling force to either one of said pair of pull tabs.

12. A chalk bag for climbing, said chalk bag comprising:

a flexible bag structure formed of cloth and having a hemmed upper opening to an internal cavity, said bag structure including opposite wall portions cooperatively defining said opening, said cloth of said bag structure being selected to contain chalk in said cavity;

a belt loop attached adjacent to said opening for securing said flexible bag structure to the belt of a climber;

a closure device disposed within said hem of said opening of said flexible bag structure, said closure device including means for in an open first position disposing said flexible bag structure at said opening in a shape-retaining substantially circular configuration providing a substantially circular passage into said cavity of said bag structure, and in a closed second position disposing opposite walls at said opening of said flexible bag structure adjacent to one another to substantially close said passage into an arcuate substantially half-circular shape;

wherein said closure device includes a substantially rigid and substantially half-circular member partially circumscribing said opening and having a pair of opposite end portions, an elongate resilient flexible member also having a pair of end portions and also being of substantially half-circular shape in said open first position and said closed second position of said closure device, said flexible member partially circumscribing said opening in opposition to said rigid member in said open first position of said closure device, and hinge means attaching respective adjacent end portions of said substantially rigid member and said flexible member to one another so as to allow said flexible member to flex between said first and said second positions, in said closed second position said flexible member laying adjacent to said rigid member to urge opposite walls of said bag structure into association with one another at said opening, thereby closing said opening into a substantially half-circular arcuate shape;

wherein said hinge means of said closure device includes said substantially rigid member and said flexible member being integral with one another and cooperatively defining a flexible connecting integral hinge portion connecting adjacent end portions of said substantially rigid member and of said elongate resilient flexible member to one another; and wherein said hinge means of said closure device includes a length of heat-shrink tubing connecting adjacent end portions of said substantially rigid member and of said elongate resilient flexible member to one another in spaced apart relation to provide therebetween a flexible integral hinge portion of said heat-shrink tubing.

* * * * *